US009413108B2

(12) United States Patent
Iwatani

(10) Patent No.: US 9,413,108 B2
(45) Date of Patent: Aug. 9, 2016

(54) LEVER-ACTUATED ELECTRICAL CONNECTOR AND MATING SYSTEM

(71) Applicant: Tyco Electronics Japan G.K., Kanagawa (JP)

(72) Inventor: Shingo Iwatani, Kanagawa-ken (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 14/472,901

(22) Filed: Aug. 29, 2014

(65) Prior Publication Data

US 2015/0064953 A1 Mar. 5, 2015

(30) Foreign Application Priority Data

Sep. 2, 2013 (JP) ..... 2013-181060

(51) Int. Cl.
*H01R 13/629* (2006.01)
*H01R 13/66* (2006.01)
*H01R 13/703* (2006.01)

(52) U.S. Cl.
CPC ..... *H01R 13/62933* (2013.01); *H01R 13/6295* (2013.01); *H01R 13/62938* (2013.01); *H01R 13/62977* (2013.01); *H01R 13/6683* (2013.01); *H01R 13/7031* (2013.01)

(58) Field of Classification Search
CPC ..... H01R 13/62933; H01R 13/62938; H01R 13/6295; H01R 13/62977; H01R 13/6683; H01R 13/7031
USPC ..... 439/341, 157, 489, 490, 460, 468, 188
See application file for complete search history.

(56) References Cited

U.S. PATENT DOCUMENTS 3,960,428 A * 6/1976 Naus ..... H01R 13/7035 116/200
5,647,754 A 7/1997 Kohno
(Continued)

FOREIGN PATENT DOCUMENTS

EP 1770830 A1 4/2007
JP 2008-108467 5/2008
(Continued)

OTHER PUBLICATIONS

French Search Report and Opinion, dated Mar. 18, 2016, 7 pages.
(Continued)

*Primary Examiner* — Abdullah Riyami
*Assistant Examiner* — Nelson R Burgos-Guntin
(74) *Attorney, Agent, or Firm* — Barley Snyder

(57) ABSTRACT

A lever-actuated electrical connector is disclosed having a housing mateable with a mating connector having complementary mating detection terminal. A mating detection terminal is positioned in the housing to form a detection circuit when in contact with the complementary mating detection terminal. A mating lever is supported by the housing. A housing lock is positioned on the housing and in contact with the mating lever when the housing is mated to the mating connector, with the housing lock being displaceable by an operation of the mating lever. The mating detection terminal is positioned at a distance from the counterpart mating detection terminal when the mating lever is in an unlocked positioned, and is in contact with the counterpart mating detection terminal when the mating lever reaches the final mating position to actuate the detection circuit.

16 Claims, 7 Drawing Sheets

(56) References Cited

U.S. PATENT DOCUMENTS 5,954,527 A * 9/1999 Jhuboo ..... A61M 5/1413 361/732
6,312,275 B1 * 11/2001 Tortorella ..... H01R 13/6395 361/759
7,014,511 B2 * 3/2006 Sagawa ..... H01R 13/4365 439/752
7,445,491 B2 * 11/2008 Fujii ..... H01R 13/62938 439/157
7,922,504 B2 * 4/2011 Sakamaki ..... H01R 13/4361 439/157
7,959,452 B2 * 6/2011 Komiyama ..... H01R 13/62977 439/157
2001/0021599 A1 * 9/2001 Kurimoto ..... H01R 13/62938 439/157
2007/0059968 A1 3/2007 Ohtaka et al.
2007/0134969 A1 * 6/2007 Endo ..... B41J 2/16579 439/341
2008/0233778 A1 * 9/2008 Moll ..... H01R 13/7032 439/188
2012/0094509 A1 * 4/2012 Bryan ..... B60Q 11/005 439/76.1
2013/0280935 A1 * 10/2013 Shishikura ..... H01R 13/62977 439/157
2014/0106585 A1 * 4/2014 Shimizu ..... H01R 13/64 439/157
2014/0113470 A1 * 4/2014 Shimizu ..... H01R 13/62955 439/157
2014/0206225 A1 * 7/2014 Myer ..... H01R 13/641 439/489
2014/0370734 A1 * 12/2014 Mathews ..... H01R 12/7011 439/157
2015/0064953 A1 * 3/2015 Iwatani ..... H01R 13/62933 439/341
2015/0079830 A1 * 3/2015 Iwatani ..... H01R 13/6295 439/310
2015/0093926 A1 * 4/2015 Henmi ..... H01R 13/62955 439/157
2015/0171551 A1 * 6/2015 Iwatani ..... H01R 13/6275 439/352

FOREIGN PATENT DOCUMENTS

JP 2008103185 A 5/2008
JP 2009-117045 5/2009
JP 2012-150959 8/2012

OTHER PUBLICATIONS

Abstract of JP 2008103185, dated May 1, 2008, 1 page.
Abstract of EP 1770830, dated Apr. 4, 2007, 1 page.

* cited by examiner

LEVER-ACTUATED ELECTRICAL CONNECTOR AND MATING SYSTEM

CROSS-REFERENCE TO RELATED APPLICATIONS

This application claims the benefit of the filing date under 35 U.S.C. §119(a)-(d) of Japanese Patent Application No. 2013-181060, dated Sep. 2, 2013.

FIELD OF THE INVENTION

The invention generally is generally related to an electrical connector, and more specifically to an electrical connector that detects when the electrical connector has been completely mated with a complementary electrical connector.

BACKGROUND

Certain electrical connectors ("connectors") have a large number of contacts depending on the connector's application. To mate or disconnect these connectors from each other, a large force is required to overcome the friction generated by the contacts. Lever-actuated connectors are often used in these applications, where the mating and disconnecting of the connector from a mating connector is performed by using the mechanical advantages provided by leverage.

Conventionally, a lever is mounted on a plug housing of a lever-actuated connector, such as a connector housing female terminals. The lever rotates between an initial mating position and a final mating position. A receptacle housing of a mating connector, such as a connector housing male terminals, is provided with a cam pin. With the lever being held at the initial mating position, both housings are partially mated together, thereby causing the cam pin to enter a cam groove provided in the lever. From this state, the lever is rotated to the final mating position. Then, with a cam operation in which the cam groove and the cam pin are engaged together, both housings are mated together, and terminals of both connectors are electrically connected together.

The term "rotate" and its derivatives refer to both clockwise rotation and counterclockwise rotation, unless otherwise specified.

One drawback of lever-actuated connectors is that determining visually whether the connectors have completely mated is difficult. Therefore, other methods are necessary to confirm whether mating is complete.

Various conventional mating detection methods are known, such as the one described in Japanese Patent Application No. 2012-150959 A, which provides a terminal to detect whether devices have been connected together.

Similarly, Japanese Patent Application No. 2009-117045 A discloses a lever-actuated connector having a terminal for mating detection. Prior to mating the mating detection terminal is separate from a counterpart mating detection terminal and after mating has been completed, the mating detection terminal is in contact with the counterpart mating detection terminal to form a detection circuit. The detection circuit electrically detects whether normal mating has been completed.

However, in spite of the utility of the detection circuit, Japanese Patent Application No. 2009-117045 A presents a number of disadvantages. For example, a detection arm is displaced by operation of a mating lever, and the mating detection terminal is elastically displaced by operation of the detection arm to control contact or non-contact with the counterpart mating detection terminal. Further, multiple connector members necessary for operating the detection arm (a pressuring member and a pre-pressuring member) are provided to the lever. These additional components increase the complexity of the connector, and results in undesirable increases in cost.

There is a need for a lever-actuated electrical connector with a reduced number of elements that is capable of achieving a mating detection function.

SUMMARY

It is therefore an object of the invention to disclose a lever-actuated electrical connector of the present invention made to achieve the objects described above. The lever-actuated electrical connector includes a housing mateable with a mating connector having complementary mating detection terminal. A mating detection terminal is positioned in the housing to form a detection circuit when in contact with the complementary mating detection terminal. A mating lever is supported by the housing. A housing lock is positioned on the housing and in contact with the mating lever when the housing is mated to the mating connector, with the housing lock being displaceable by an operation of the mating lever. The mating detection terminal is positioned at a distance from the counterpart mating detection terminal when the mating lever is in an unlocked positioned, and is in contact with the counterpart mating detection terminal when the mating lever reaches the final mating position to actuate the detection circuit.

BRIEF DESCRIPTION OF THE DRAWINGS

The invention will now be described by way of example with reference to the accompanying figures, of which.

DETAILED DESCRIPTION

Figure 1:
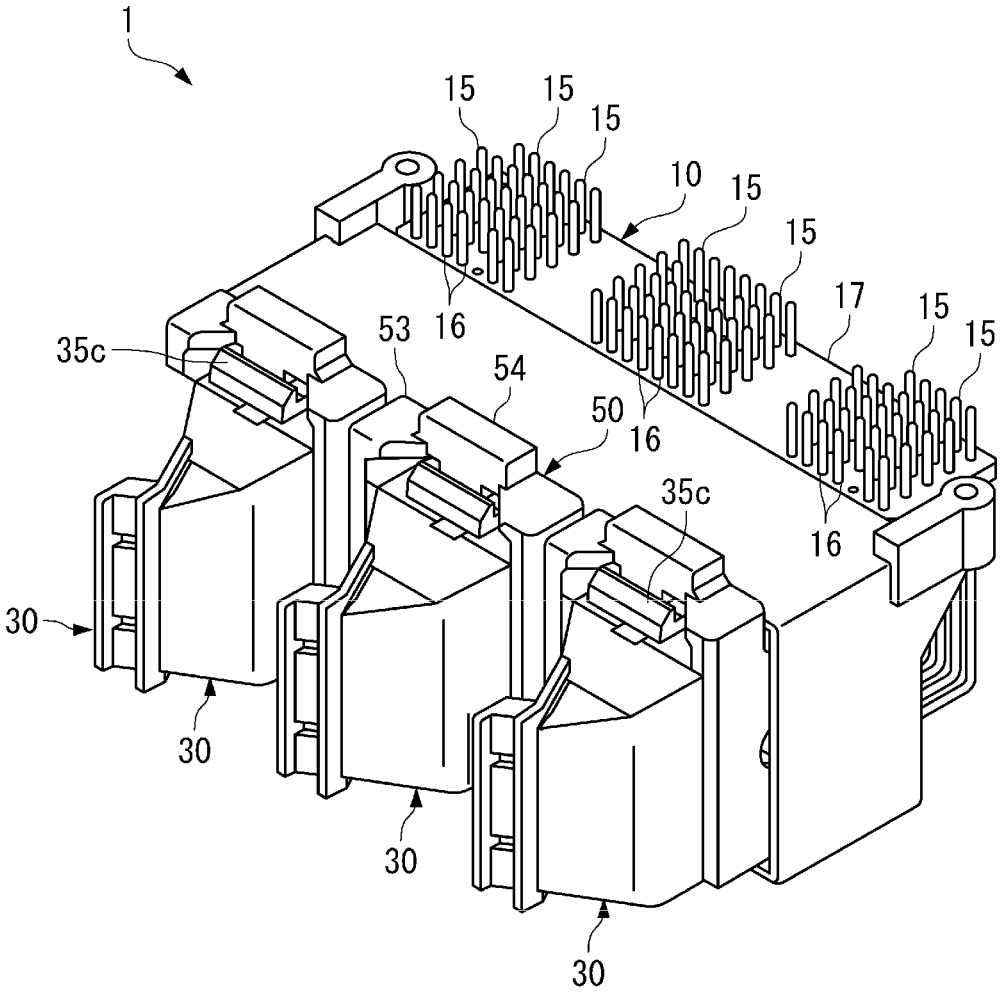
FIG. 1 is a perspective view of a connector.
Figure 2:
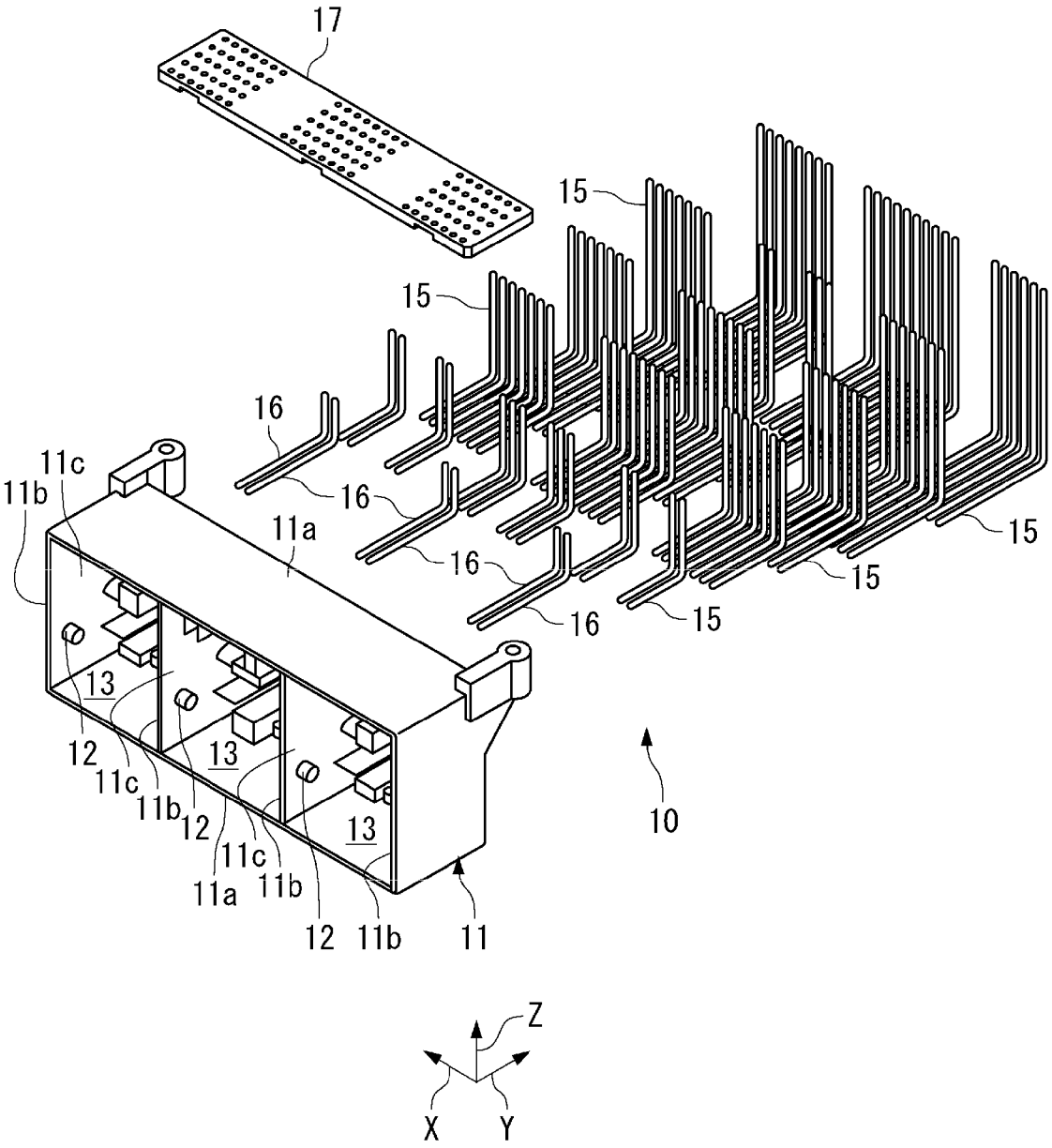
FIG. 2 is an exploded perspective view of a male connector forming the connector assembly of FIG. 1.
Figure 3:
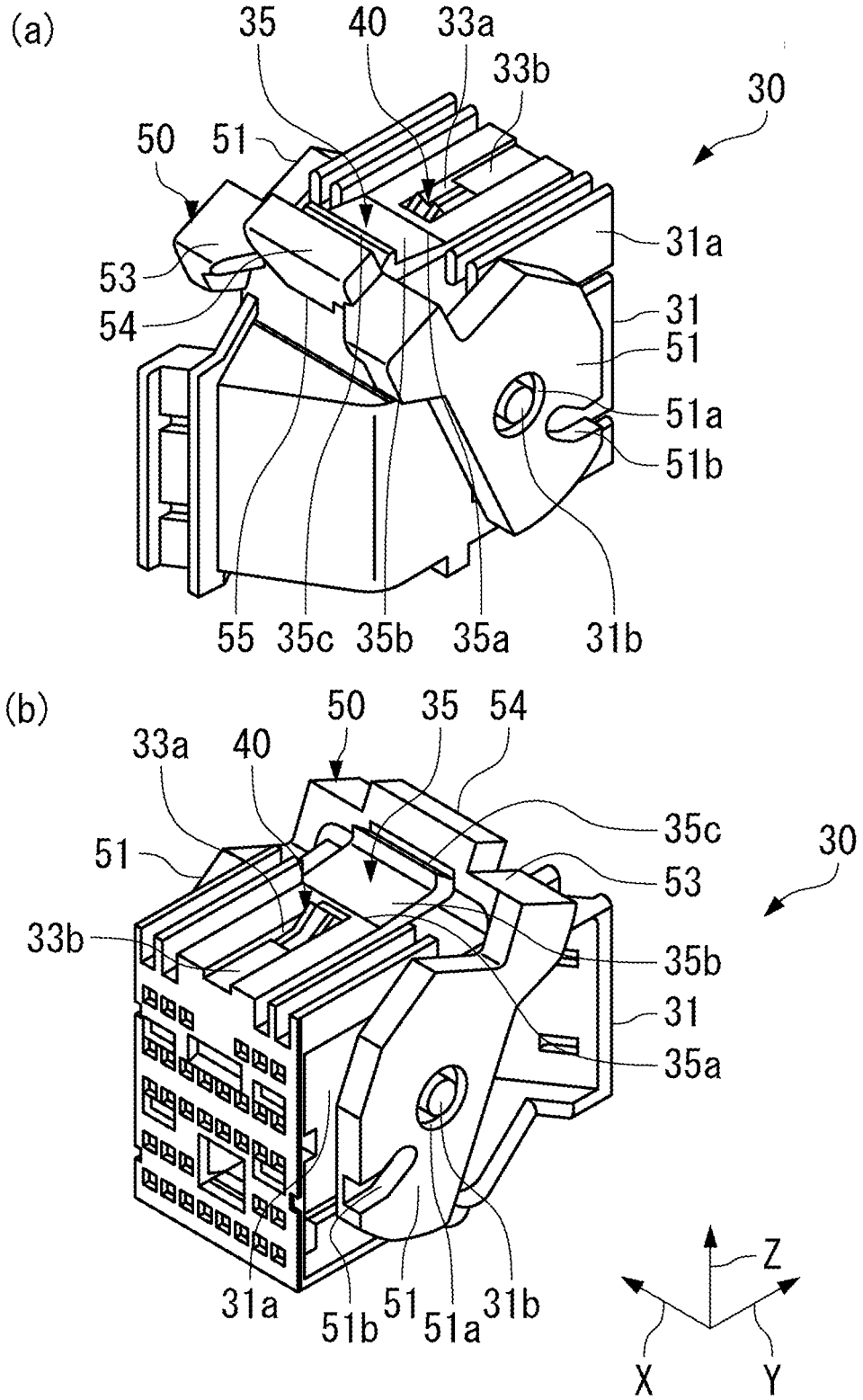
FIG. 3A is a perspective view of a lever-actuated female connector forming the connector assembly of FIG. 1 when viewed from a rear side.
FIG. 3B is a perspective view of the lever-actuated female connector forming the connector assembly of FIG. 1 when viewed from a front side.
Figure 4:
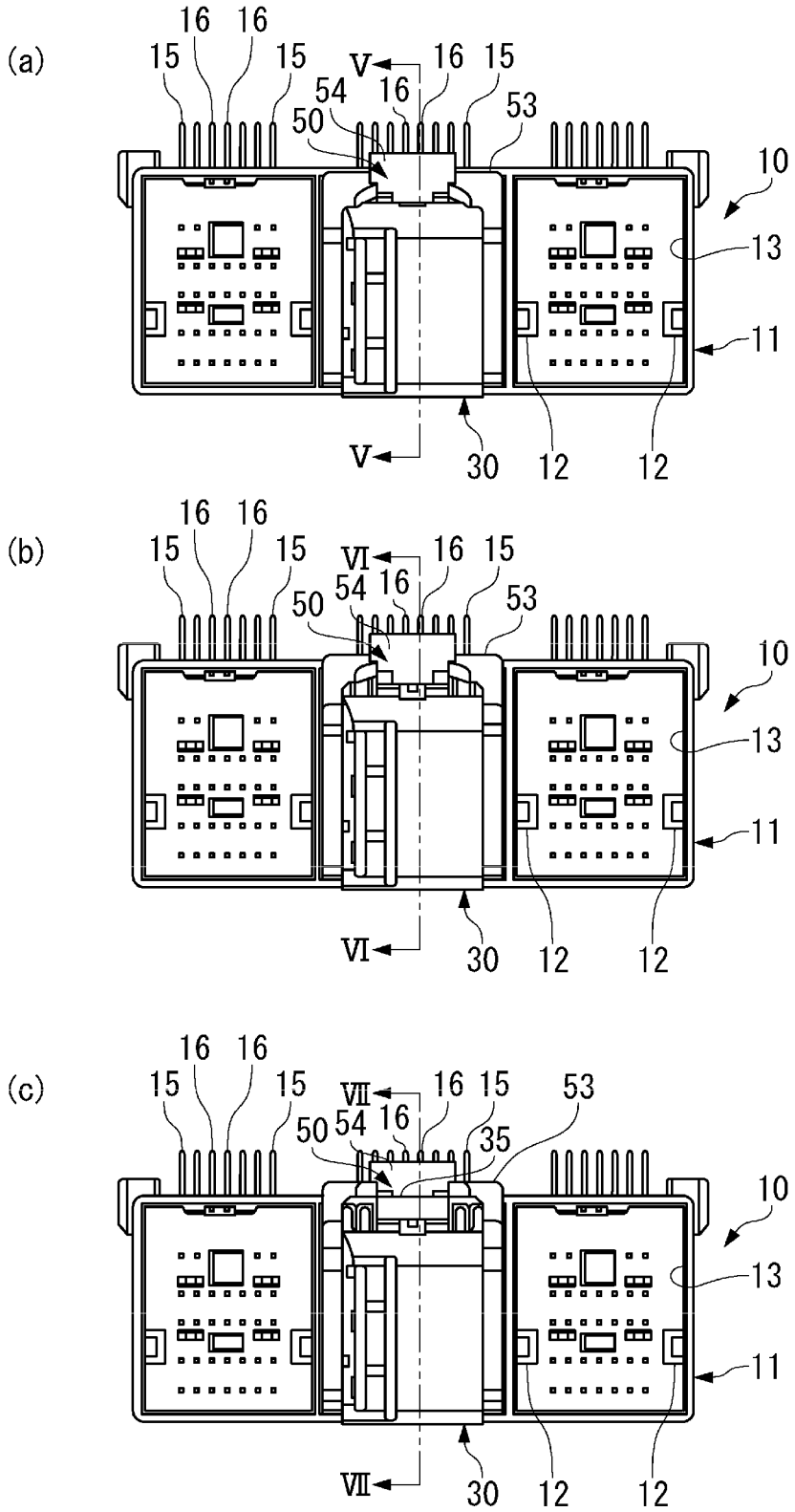
FIG. 4A is a front view of the connector assembly when viewed from the rear side of the female connector before a lever operation.
FIG. 4B is a front view of the connector assembly when viewed from the rear side of the female connector during a lever operation.
FIG. 4C is a front view of the connector assembly when viewed from the rear side of the female connector after a lever operation is completed.
Figure 5:
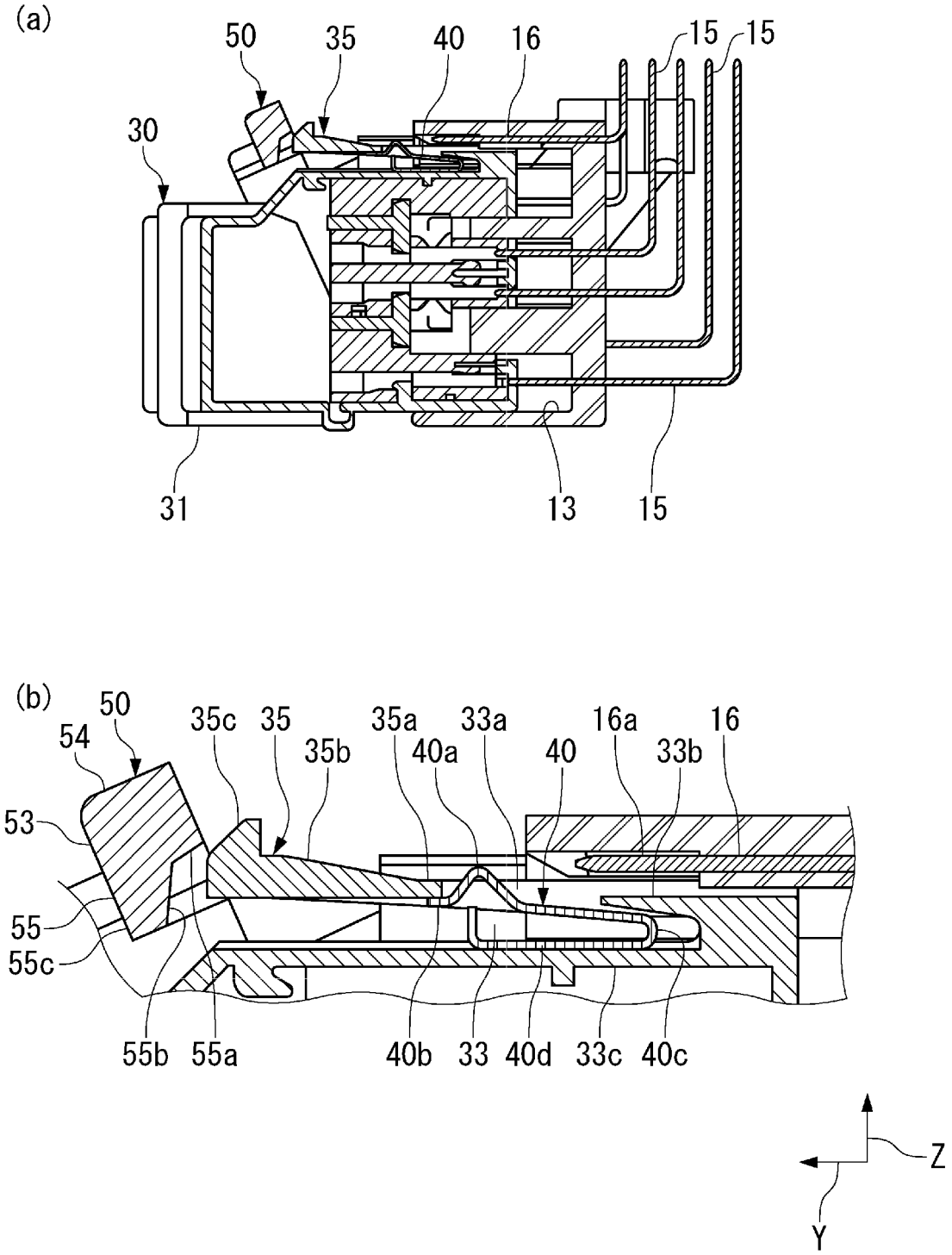
FIG. 5A is a sectional view taken along line V-V of FIG. 4A.
FIG. 5B is an enlarged view of a part of FIG. 5A.
Figure 6:
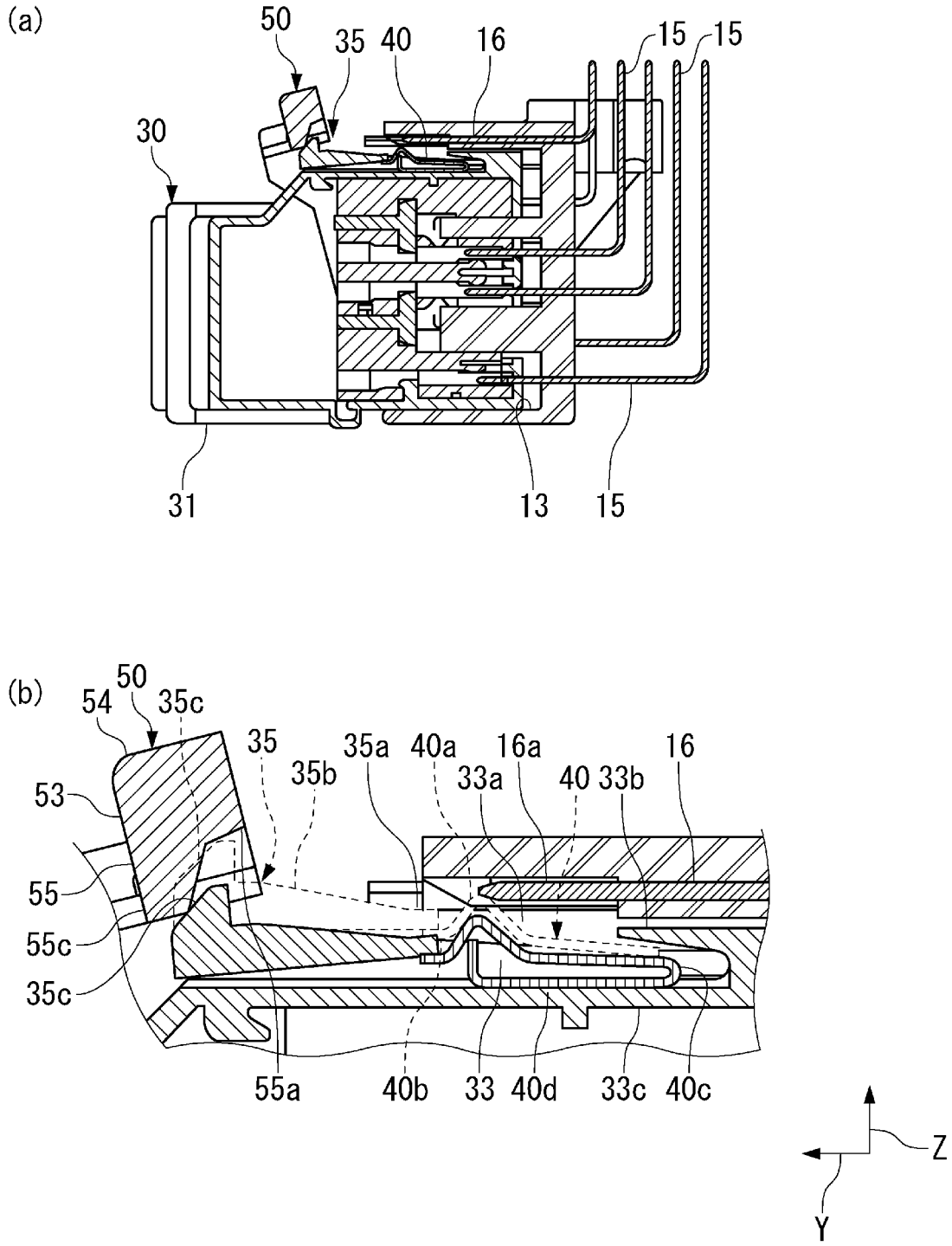
FIG. 6A is a sectional view taken along line VI-VI of FIG. 4B.
FIG. 6B is an enlarged view of a part of FIG. 6A.
Figure 7:
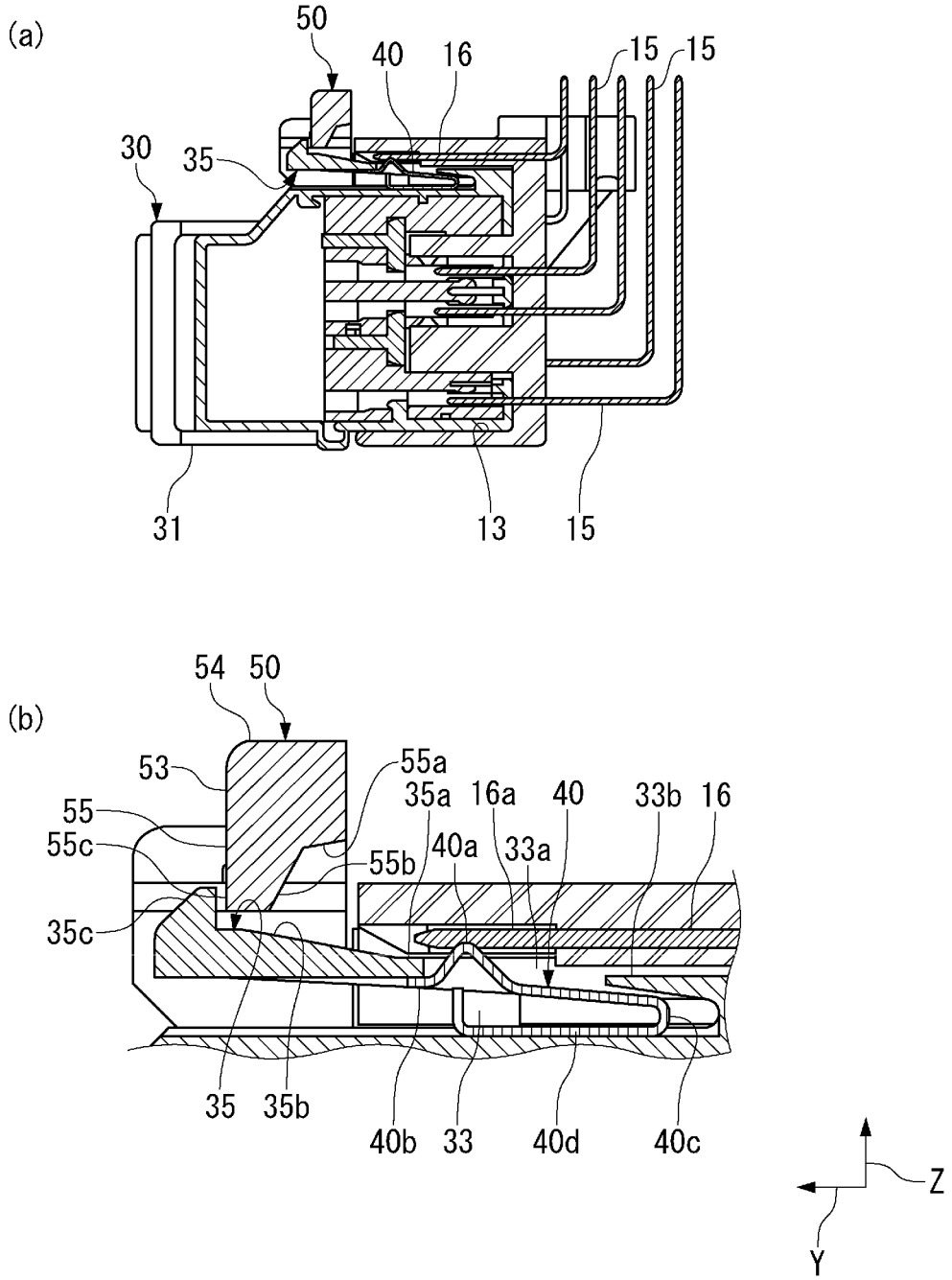
FIG. 7A is a sectional view taken along line VII-VII of FIG. 4C.
FIG. 7B is an enlarged view of a part of FIG. 7A.

An electrical connector assembly 1 according to an embodiment of the present invention is described below with reference to the attached drawings.

As shown in FIGS. 1-3B, the electrical connector assembly 1 includes a mating connector 10 and connectors 30, each having a mating side defined as front, and its opposite side defined as rear.

The mating connector 10 includes a mating housing 11, receiving chambers 13 provided inside the mating housing 11 to have the connectors 30 inserted therein, a plurality of pin-type signal terminals 15, and mating detection terminals 16 for detecting that the mating connector 10 and the connectors 30 are mated together (See FIGS. 5*a*-7*b*). The signal terminals 15 and the mating detection terminals 16 are held by press-fitting into the rear mating housing 11, and are partially positioned inside the receiving chambers 13, with the remaining portions positioned outside the mating housing 11. The mating connector 10 includes a tine plate 17 which holds the signal terminals 15 in an aligned state outside the mating housing 11.

The mating housing 11, and a housing 31 and a mating lever 50 of each connector 30 is integrally formed by injection-molding of insulating resin. The signal terminals 15 and the mating detection terminals 16 are formed of a metal material having excellent conductivity and elasticity, such as copper alloy.

The mating housing 11 includes three receiving chambers 13 aligned in a width direction X The connectors 30 are inserted into and mated with the respective receiving chambers 13.

The mating housing 11 includes side walls 11*a* defining the receiving chambers 13 in the width direction X and side walls 11*b* defining the receiving chambers 13 in a height direction Z. Each side wall 11*b* has cam pins 12 on inner surfaces 11*c* facing each other in each receiving chamber 13. At the time of mating of the connector 30, each cam pin 12 is inserted in a cam groove 51*b* provided in the mating lever 50 to be engaged with the mating lever 50. When the mating lever 50 is rotated in a predetermined direction, the cam pin 12 moves inside the cam groove 51*b* to cause a leverage effect.

As shown in FIG. 5A, the mating detection terminal 16 has a first end extending forward of the receiving chamber 13, the first end functioning as a contact end 16*a* to contact a mating detection terminal 40 provided in the connector 30. An opposing second end extends outside of the mating housing 11 and connects to a device for detection.

Since FIG. 5A is a sectional view, only one mating detection terminal 16 is depicted. However, in the embodiment shown in FIG. 2, the mating housing 11 includes two mating detection terminals 16 spaced apart from each other in the width direction X. These two mating detection terminals 16 cannot establish electrical continuity until the mating detection terminal 40 of the connector 30 makes contact therewith. When the mating detection terminal 40 makes contact with both mating detection terminals 40, these terminals function as a detection circuit.

Each connector 30 is inserted in the respective receiving chambers 13 of the mating connector 10 to mate with the mating connector 10, and includes a plurality of socket-type terminals ("female terminals")(not shown) to be connected to the plurality of signal terminals 15 for signal transmission. The connector 30 is a lever-actuated electrical connector having a housing 31 with the plurality of the female terminals and a mating lever 50 for mating the connector 30 with the mating connector 10.

In an exemplary embodiment, the shape of the connectors 30 may vary. In another exemplary embodiment, the shape of the connectors 30 are substantially the same.

As shown in FIGS. 3A, 3B, 5A, and 5B, the connector 30 includes the mating detection terminal 40 on an upper side of the housing 31 in the height direction Z and at the center thereof in the width direction X.

The mating detection terminal 40 is held in a detection terminal receiving chamber 33 provided in the housing 31. The detection terminal receiving chamber 33 includes a window 33*a* open to an upper surface of the housing 31. When the connector 30 is not connected, a portion of the mating detection terminal 40 is exposed outside through the window 33*a*.

The detection terminal receiving chamber 33 includes a holding wall 33*b* in front of the window 33*a*. The holding wall 33*b* is provided so as to be separated in the height direction Z at a predetermined space apart from a bottom wall 33*c* defining the detection terminal receiving chamber 33. A front end side of the mating detection terminal 40 is positioned between the holding wall 33*b* and the bottom wall 33*c*.

The housing 31 includes a housing lock 35 in the rear of the window 33*a*. The housing lock 35 engages with the mating lever 50 at a normal mating position, thereby inhibiting the connector 30 from being inadvertently disconnected from the mating connector 10.

The housing lock 35 is integrally formed with the housing 31, and includes a hinge 35*a* connected to the housing 31, an arm 35*b* extending rearward from the hinge 35*a*, and an engaging projection 35*c* provided at a tip (a rear end) of the arm 35*b*. The engaging projection 35*c* projects upward. In the housing lock 35, the arm 35*b* can rotate together with the engaging projection 35*c* about the hinge 35*a*. When the mating lever 50 is operated for mating, the housing lock 35 is once elastically displaced downward (pushed down) when the engaging projection 35*c* engages with the mating lever 50. When the mating lever 50 rotates and moves to the normal mating position, the engagement with the mating lever 50 is released, and the housing lock 35 elastically returns to its original position.

As depicted in FIG. 5B, the mating detection terminal 40 includes a folded member 40*c* bent in a U shape at a substantially center portion in a length direction, a contact member 40*a* provided on a first side continued from the folded member 40*c*, and an engaging member 40*b* provided in the rear of the contact member 40*a*. The contact member 40*a* is a portion which projects upward and directly makes contact with the mating detection terminal 16 of the mating connector 10. The mating detection terminal 40 also includes a support member 40*d* on an opposing second side continued from the folded member 40*c*. The mating detection terminal 40 on is branched into two at the folded member 40*c* as a boundary, and the contact member 40*a* and the engaging member 40*b* are provided on each branched portion.

In the mating detection terminal 40, the support member 40*d* on the second side is supported by the bottom wall 33*c* inside the detection terminal receiving chamber 33. Furthermore, with the folded member 40*c* being inserted into a gap between the holding wall 33*b* and the bottom wall 33*c* and also with the engaging member 40*b* being engaged with a lower surface of the hinge 35*a* of the housing lock 35, the mating detection terminal 40 is positioned inside the detection terminal receiving chamber 33. Still further, since the engaging member 40*b* is engaged with the lower surface of the hinge 35*a*, when the housing lock 35 is pushed down by the mating lever 50, the folded member 40*c* is elastically deformed to cause the contact member 40*a* to be displaced downward. At this position, the contact member 40*a* is not in contact with the mating detection terminal 16. When the load from the mating lever 50 is released, the contact member 40*a* elastically returns to the original position.

The mating lever 50 is rotatably supported by the housing 31. The mating lever 50 operates as a leverage mechanism when the connector 30 is mated with and is disconnected from the counterpart connecter 10.

The mating lever 50 rotates in a range from an initial mating position depicted in FIGS. 3A, 3B, 5A, and 5B to a final mating position depicted in FIGS. 1, 7A, and 7B. When the mating lever 50 is rotated from the initial mating position to the final mating position in a clockwise direction, the connector 30 is mated with the mating connector 10.

As depicted in FIGS. 3A and 3B, the mating lever 50 includes a pair cam plates 51 and an operating rod 53. The operating rod 53 couples tips of the pair of cam plates 51 together, and has a gate shape.

Each cam plate 51 is formed with a shaft receiving hole 51*a* penetrating through both front and rear surfaces of the cam plate 51. Into the shaft receiving hole 51*a*, a support shaft 31*b* integrally formed on the side wall 31*a* of the housing 31 is inserted. The mating lever 50 is rotatably supported by the housing 31, with the support shaft 31*b* taken as a rotation center.

Each cam plate 51 has the cam groove 51*b* formed in a surface side not facing the housing 31. The cam pin 12 of the mating housing 11 is inserted into the cam groove 51*b*. The cam groove 51*b* is provided on the side opposite to the side where the operating rod 53 is provided, with the shaft receiving hole 51*a* and support shaft 31*b* taken as a boundary. With the rotation of the operating rod 53, the cam pin 12 relatively moves deeper along the cam groove 51*b*, thereby allowing the mating connector 10 and the connector 30 to be mated together and be disconnected.

As depicted in FIGS. 3A, 3B, and 5B, the operating rod 53 includes a projection 54 provided at the center in the width direction, and a block 55 provided inside in a rotation radius with respect to the projection 54.

The projection 54 outward from the rotation radius. By pushing the projection 54 in a direction along the rotation radius, an operator can perform a mating or disconnecting operation.

As depicted in FIG. 5B, the block 55 includes a first guide surface 55*a* and a second guide surface 55*b*, which are both flat and formed by cutting an inner side in the rotation radius. When the mating lever 50 is rotated for mating, the engaging projection 35*c* of the housing lock 35 makes contact with the first guide surface 55*a* and then the second guide surface 55*b*. In the first guide surface 55*a* and the second guide surface 55*b*, while portions where these guide surfaces are contiguous are located equidistant from the rotation center at the support shaft 31*b*, the distance from the rotation center to the second guide surface 55*b* is less than the distance from the rotation center to the first guide surface 55*a*. In particular, a tilt is formed so that the distance from the rotation center contiguously becomes shorter from a point (a starting point) continued from the first guide surface 55*a* toward an end point where the second guide surface 55*b* is interrupted. Therefore, the amount of downward displacement of the engaging projection 35*c* increases as the contact point moves from the first guide surface 55*a* to the second guide surface 55*b* and then further moves toward the end point of the second guide surface 55*b*. With the guide surface, such as the first guide surface 55*a* and the second guide surface 55*b*, as a simple component being formed on the rod 53, the connector 30 can provide a necessary displacement to the housing block 35.

The block 55 also includes a lock surface 55*c* on a rear surface of the cutout portion. When the mating lever 50 reaches the final mating position, the lock surface 55*c* is engaged with the engaging projection 35*c* of the housing lock 35, thereby regulating rotation of the mating lever 50 in a disconnecting direction.

Next, a process in which the mating detection terminal 16 and the mating detection terminal 40 make contact with each other when the connector 30 is mated with the mating connector 10 is described with reference to FIGS. 4A-7B.

Prior to a mating operation, the connector 30 is positioned and is then inserted into the receiving chamber 13 of the mating connector 10. As depicted in FIGS. 5A and 5B, the mating lever 50 is positioned away from the housing lock 35, so the housing lock 35 and the mating detection terminal 40 are at their initial, premating positions. The contact member 40*a* of the mating detection terminal 40 reaches a height where its tip interferes with the mating detection terminal 16, but is at a position away in a front-and-rear direction Y. Therefore, prior to the mating operation, the mating detection terminal 16 and the mating detection terminal 40 do not establish electrical continuity.

To mate the connector 30 with the mating connector 10, the connector 30 is pushed into the receiving chamber 13 until the cam pins 12 are inserted into the cam grooves 51*b*. The mating lever 50 is then rotated. In the present embodiment depicted in FIGS. 5A-7B, the mating lever 50 is rotated in a clockwise direction.

When the mating lever 50 is rotated from the state of shallow insertion depicted in FIGS. 5A and 5B, each cam pin 12 relatively moves deeper toward the cam groove 51*b* as being engaged with the cam groove 51*b*. In association with this movement, the connector 30 moves deeper toward the receiving chamber 13 of the mating connector 10, towards the final mating position.

The mating detection terminal 40 operates through the housing lock 35 following the operation of the mating lever 50.

The engaging projection 35*c* of the housing lock 35 first slides over the first guide surface 55*a* to be pushed downward. When the mating lever 50 is further rotated, the engaging projection 35*c* relatively moves from a position depicted in FIGS. 5A and 5B to a position depicted in FIGS. 6A and 6B, thereby sliding on the second guide surface 55*b*. This action results in the housing lock 35 and the mating detection terminal 40 both being displaced downward. While the engaging projection 35*c* is sliding on the second guide surface 55*b*, the contact member 40*a* of the mating detection terminal 40 reaches a position where the contact member 40*a* can interfere with the mating detection terminal 16 in the front-and-rear direction Y. However, the tip of the contact member 40*a* is pushed down to a position lower than the mating detection terminal 16. The result is that the mating detection terminal 16 and the mating detection terminal 40 do not establish electrical continuity.

When the engaging projection 35*c* of the housing lock 35 passes over the second guide surface 55*b* and the mating lever 50 is further rotated, the block 55 goes over the engaging projection 35*c* to cause the mating lever 50 to reach the final mating position, as depicted in FIGS. 7A and 7B. The connector 30 moves to the deepest position of the receiving chamber 13 of the mating connector 10, and mating of the mating connector 10 and the connector 30 together is completed.

The housing lock 35 is pushed down, then elastically returns to the initial position. The mating detection terminal 40 also elastically returns toward the initial position, and the contact member 40*a* makes contact with the mating detection terminal 16. The contact of the mating detection terminal 16 with the mating detection terminal 40 forms a detection circuit. The result is that by having a mating device connected to the mating detection terminal 40, the mating of the mating connector 10 and the connector 30 can be established by the presence of electrical continuity therebetween.

Further, with the engaging projection 35*c* engaged with the lock surface 55*c* of the block 55, rotation of the mating lever 50 in a direction of unmating is prevented, allowing for a secure mating connection to be established.

As has been described in the foregoing, in the electrical connector assembly 1, the mating detection terminal 40 provided in the connector 30 does not make contact with the mating detection terminal 16 of the mating connector 10 in the course of mating from the initial mating position of the connector 30 in the mating connector 10 and before reaching the final mating position. Upon reaching the final mating position, the mating detection terminal 40 makes contact with the mating detection terminal 16. Therefore, if the operator suspends the operation of the mating lever 50 in the course of mating, electrical continuity is not detected, and it is possible to recognize that normal mating has not been established. In addition, electrical continuity is detected upon normal mating, so it is possible to recognize that mating has been completed.

The connector 30 actuates the mating detection terminal 40 by using the housing lock 35 for engaging with the mating lever 50. Since the housing lock 35 and the mating lever 50 are primary components for a lever-actuated electrical connector, and the connector 30 uses these components to actuate the mating detection terminal 40, it is not necessary to provide any special members to actuate the mating detection terminal 40. Therefore, according to the connector 30, a lever-actuated electrical connector is disclosed with a simple structure that is capable of achieving a mating detection function.

Further advantages are that the connector 30 can reliably displace the housing lock 35 by following the rod 53 to which force is exerted when the operator operates the mating lever 50. Therefore, a necessary actuation of the mating detection terminal 40 following the displacement of the housing lock 35 is reliably performed.

While exemplary embodiments of the present invention have been described above, one of ordinary skill in the art would recognize that any of the structures described in the above embodiments can be selected or changed to another structure as appropriate without departing from the essence of the present invention.

The structure of the electrical connector assembly 1 of the mating connector 10 and the connector 30 is merely exemplary and not limiting. For example, the number of receiving chambers is not restricted to three, and can be set at any number equal to or more than 1. The mating detection terminal 40 can take any structure as long as the mating detection terminal 40 forms a detection circuit together with the mating detection terminal 16 of the mating connector 10 and necessary operations can be performed in the course of mating.

What is claimed is:

1. A lever-actuated electrical connector comprising:

a housing mateable with a mating connector having a complementary mating detection terminal;

a mating detection terminal positioned in the housing to form a detection circuit when in contact with the complementary mating detection terminal;

a mating lever supported by the housing;

a housing lock positioned on the housing and preventing the mating lever from moving to an unlocked position when the housing is mated to the mating connector, the housing lock being displaceable by an operation of the mating lever, and the mating detection terminal being positioned at a distance from the complementary mating detection terminal when the mating lever is in the unlocked position, and in contact with the complementary mating detection terminal when the mating lever reaches a final mating position to actuate the detection circuit.

2. The lever-actuated electrical connector according to claim 1, wherein the mating lever includes a pair of swing bodies rotatably supported by the housing.

3. The lever-actuated electrical connector according to claim 2, wherein the mating lever further includes a body coupling the pair of swing bodies.

4. The lever-actuated electrical connector according to claim 2, wherein the housing lock is displaced by following displacement of the body.

5. The lever-actuated electrical connector according to claim 4 wherein the mating detection terminal contacts the counterpart mating detection terminal by displacement of the housing lock.

6. The lever-actuated electrical connector according to claim 3, wherein the body comprises a guide surface upon which the housing lock slides before the mating lever reaches the final mating position.

7. The lever-actuated electrical connector according to claim 6, wherein the body further comprises a rear portion of the guide surface set at a shorter distance from a center of rotation of the mating lever than a front portion of the guide surface.

8. A mating system comprising:

a mating connector having a counterpart mating detection terminal; and an electrical connector having a mating lever, a mating detection terminal which forms a detection circuit when in contact with the counterpart mating detection terminal, and a housing lock that engages the mating lever when the mating of the electrical connector with the mating connector is complete, the housing lock being displaceable by an operation of the mating lever, the mating detection terminal being positioned at a distance from the counterpart mating detection terminal when the mating lever is in an unlocked positioned, and in contact with the counterpart mating detection terminal when the mating lever is in a final mating position.

9. The mating system according to claim 8, wherein the mating connector includes a mating housing having an electrical connector receiving chamber.

10. The mating system according to claim 9, wherein the receiving chamber has a pair of sidewalls.

11. The mating system according to claim 10, wherein each sidewall has a cam pin projecting into the receiving chamber, with one cam pin projects toward the other cam pin.

12. The mating system according to claim 11, wherein the mating lever has a pair of cam grooves.

13. The mating system according to claim 12, wherein each cam pin is inserted into one of the cam grooves when the electrical connector is inserted into the electrical connector receiving chamber.

14. The mating system according to claim 13, wherein when the mating lever is rotated, the cam pins move inside the cam groove through a leverage effect.

15. The mating system according to claim 8, wherein the mating lever includes a pair of swing bodies rotatably supported by the housing.

16. The mating system according to claim 15, wherein the mating lever further includes a body coupling the pair of swing bodies.

* * * * *